US007669382B2

(12) United States Patent
Burton et al.

(10) Patent No.: US 7,669,382 B2
(45) Date of Patent: Mar. 2, 2010

(54) WINDOW INSTALLATION METHOD

(75) Inventors: Cordell R. Burton, Pella, IA (US); Timothy D. Dorenkamp, Pella, IA (US); Michael J. Kugel, Des Moines, IA (US); Evan R. Vande Haar, Pella, IA (US); Bruce A. Baier, Pella, IA (US); Mark Mullen, Pella, IA (US); Jason L. Jungling, Altoona, IA (US)

(73) Assignee: Pella Corporation, Pella, IA (US)

( * ) Notice: Subject to any disclaimer, the term of this patent is extended or adjusted under 35 U.S.C. 154(b) by 695 days.

(21) Appl. No.: 11/427,636

(22) Filed: Jun. 29, 2006

(65) Prior Publication Data

US 2006/0272274 A1 Dec. 7, 2006

(51) Int. Cl.
*E06B 3/00* (2006.01)

(52) U.S. Cl. ..... 52/745.16; 52/741.4; 52/204.55; 52/208; 52/62; 49/506

(58) Field of Classification Search ..... 52/745.16, 52/745.15, 204.53, 204.55, 215, 216, 211, 52/58, 62, 742.13, 204.599; 49/506, 504, 49/475.1

See application file for complete search history.

(56) References Cited

U.S. PATENT DOCUMENTS 1,377,349 A * 5/1921 Holder ..... 52/62
1,929,633 A * 10/1933 Gifford ..... 52/215
2,497,515 A * 2/1950 Pearse ..... 52/204.599
2,700,441 A 1/1955 Cudini
3,250,049 A 5/1966 Sklar
3,375,627 A * 4/1968 Bursiek et al. ..... 52/213
3,566,542 A * 3/1971 Gillen et al. ..... 49/504
3,585,770 A 6/1971 Maizler
3,690,079 A 9/1972 Hemminger
3,782,064 A 1/1974 Hubbard et al.
3,851,420 A 12/1974 Tibbetts
3,861,444 A * 1/1975 Portwood ..... 160/90
3,889,423 A 6/1975 Begin (Continued)

OTHER PUBLICATIONS

Jeld Wen Windows and Doors, "Installation Instructions for New Construction Vinyl Window with Integral Nailing Fin," 6 pp., Mar. 2003.

(Continued)

*Primary Examiner*—Robert J Canfield
*Assistant Examiner*—Brent W Herring
(74) *Attorney, Agent, or Firm*—Faegre & Benson LLP

(57) ABSTRACT

A closure assembly and a method of installing the closure assembly are provided. A insertion opening is formed in water resistant barrier covering a rough opening that generally corresponds to a perimeter of the rough opening. A drainage system including a channel assembly is installed on a sill surface of the rough opening. The closure assembly is inserted into the rough opening and temporarily secured to the structure. At least one shim carried on the closure assembly is adjusted to level the closure assembly in the rough opening. A sealing member attached to the closure assembly is engaged with the water resistant barrier. A foam material is delivered into at least a portion of a space between perimeter edge surfaces of the closure assembly and inner surfaces of the rough opening to permanently secure the closure assembly within the rough opening.

25 Claims, 13 Drawing Sheets

U.S. PATENT DOCUMENTS 4,001,972 A 1/1977 Hurwitz
4,055,923 A 11/1977 Biebuyck
4,228,630 A * 10/1980 Englert et al. ..... 52/656.9
4,387,542 A 6/1983 Wehr
4,473,981 A * 10/1984 Simpson ..... 52/204.53
4,488,391 A * 12/1984 Pavnica ..... 52/745.16
4,555,882 A 12/1985 Moffitt et al.
4,621,478 A 11/1986 Phillips et al.
4,637,183 A 1/1987 Metz
4,644,717 A 2/1987 Biebuyck
4,672,784 A 6/1987 Pohlar
4,691,487 A 9/1987 Kessler
4,713,922 A 12/1987 Ingold
4,715,152 A 12/1987 Tanikawa
4,731,952 A 3/1988 Mascotte
4,731,965 A 3/1988 Jensen
4,821,472 A * 4/1989 Tix ..... 52/204.55
4,844,520 A * 7/1989 Muller, Jr. ..... 292/128
4,852,312 A 8/1989 Harbom
4,887,407 A 12/1989 Nelson
4,958,469 A * 9/1990 Plummer ..... 52/204.55
5,018,333 A * 5/1991 Bruhm ..... 52/741.4
5,026,581 A 6/1991 Shea, Jr. et al.
5,042,199 A 8/1991 Schneider et al.
5,054,250 A 10/1991 Foss
5,327,684 A 7/1994 Herbst
5,365,707 A * 11/1994 Jones et al. ..... 52/211
5,423,149 A 6/1995 Herbst
5,524,391 A 6/1996 Joffe et al.
5,542,217 A 8/1996 Larivee, Jr.
5,572,840 A * 11/1996 Fast et al. ..... 52/213
5,655,343 A 8/1997 Seals
5,675,870 A 10/1997 Cooper
5,692,350 A 12/1997 Murphy, Jr.
5,701,780 A * 12/1997 Ver Meer ..... 72/379.2
5,722,207 A * 3/1998 Anderson et al. ..... 52/204.55
5,822,933 A 10/1998 Burroughs et al.
5,839,236 A 11/1998 Frey
5,857,299 A 1/1999 Gyllenberg et al.
5,890,331 A 4/1999 Hope
5,899,026 A * 5/1999 Williams et al. ..... 52/58
5,921,038 A 7/1999 Burroughs et al.
5,927,039 A * 7/1999 De Boer ..... 52/656.9
5,937,597 A 8/1999 Sono et al.
6,014,846 A 1/2000 Sono et al.
6,018,916 A * 2/2000 Henry ..... 52/126.1
6,098,343 A 8/2000 Brown et al.
6,141,922 A * 11/2000 Carlisle et al. ..... 52/204.1
6,170,198 B1 1/2001 Staples et al.
6,185,792 B1 2/2001 Nelson et al.
6,223,484 B1 * 5/2001 Minter ..... 52/213
6,256,956 B1 * 7/2001 Davis ..... 52/408
6,276,099 B1 * 8/2001 O'Shea ..... 52/204.1
6,293,061 B1 * 9/2001 Horak, Jr. ..... 52/213
6,357,200 B1 * 3/2002 Vanderpan ..... 52/745.16
6,381,911 B1 5/2002 Weiland
6,405,501 B1 6/2002 Cerrato
6,408,922 B2 6/2002 Desrochers
6,519,899 B1 * 2/2003 Hurzeler ..... 49/501
6,634,146 B2 * 10/2003 Carlson ..... 52/204.55
6,722,089 B2 4/2004 Budzinski
6,832,457 B2 * 12/2004 Geiger ..... 52/656.5
6,894,083 B2 * 5/2005 Braun et al. ..... 521/159
2002/0157328 A1 10/2002 Holder
2003/0188498 A1 * 10/2003 Lewkowitz ..... 52/208
2004/0020143 A1 * 2/2004 Webb ..... 52/204.53
2005/0138875 A1 6/2005 Grunewald et al.
2005/0144856 A1 * 7/2005 Conlin ..... 52/58
2005/0144865 A1 7/2005 Ellingson
2005/0188625 A1 9/2005 Cantrell
2005/0193654 A1 9/2005 Primozich
2005/0235571 A1 10/2005 Ewing et al.
2005/0262771 A1 12/2005 Gorman
2005/0262782 A1 12/2005 Harrison et al.
2006/0080894 A1 * 4/2006 Saelzer ..... 49/504
2006/0101726 A1 * 5/2006 Collins ..... 52/58
2006/0272238 A1 * 12/2006 Honda ..... 52/211
2007/0056231 A1 * 3/2007 DiMario et al. ..... 52/204.53
2007/0125013 A1 * 6/2007 Prince ..... 52/204.1
2007/0166498 A1 * 7/2007 Penar ..... 428/40.1
2007/0214738 A1 * 9/2007 Koessler ..... 52/302.6

OTHER PUBLICATIONS

© Pella Corporation, "Clad Double-Hung Window Installation Instructions," 5 pp., 2004.
© Pella Corporation, "Clad Casement & Awning Window Installation Instructions," 5 pp., 2004.
© Pella Corporation, "Installation Instruction, HurricaneShield™/Advanced Performance Casement and Awning Windows," 4 pp., 2001.
Jamsill, Inc, Jamsill Guard™, http://www.jamsill.com/Products.php, 5 pp., 2005.

* cited by examiner

WINDOW INSTALLATION METHOD

TECHNICAL FIELD

The present invention relates closure assemblies and methods for installing closure assemblies into a rough opening.

BACKGROUND OF THE INVENTION

One of the more time consuming jobs in the construction and restoration fields is the setting (i.e. installing, leveling, and plumbing) of closures assemblies such as doors, windows, side lights, transoms, gable air vents, portals, skylights, etc., in rough structural openings. The rough opening is typically slightly larger than the closure assembly to facilitate installation.

Installers typically use wooden shims placed and sometime driven in the gap between the closure frame or jamb and the wall studs that form the rough opening. A level is used during this process to confirm the positioning of the jamb in the opening and re-adjustment of the shims is made as necessary to complete the installing, leveling and plumbing process. Levels are used on closures that have a flat vertical or horizontal side or sides. A plumb line is used on closures where a level is ineffective, such as a circular or oval closure.

Although the wooden shim is still the dominant means today for installing closures, it does have some limitations including: (1) the method of installing with wood shims is very time consuming; (2) wood shims are difficult to use on rounded surfaces (i.e. circular, oval-portals, stained glass ovals, etc.); (3) wood shims often interfere with complete sealing of the window to the rough opening; and (4) wood shims can slip out of place during installation of the closure assembly.

A gap is typically maintained between the closure assembly and the rough opening to accommodate expansion and contraction of building materials throughout temperature changes, as well as overall shifting and settling of the structure. Water, such as airborne moisture and liquid water in the form of rainwater, ice, snow can penetrate into the building wall interior from in and around building closure assemblies.

Attempts have been made to prevent entry of water into the building wall interior by sealing or caulking entry points in and around closure assemblies as the primary defense against water intrusion, or by installing flashing around the closure assemblies to divert the water. These attempts have not been completely successful. Sealants are not only difficult and costly to properly install, but tend to separate from the closure assembly or wall due to climatic conditions, building movement, the surface type, or chemical reactions. Flashing is also difficult to install and may tend to hold the water against the closure assembly, accelerating the decay.

The efficiency of such weatherproofing relies largely on the careful installation of both the closure assembly and the weatherproofing materials. However, no matter how carefully installed, moisture may enter into gaps between the closure assembly and the rough opening. Moisture penetration may be due to shifting or expansion/contraction of materials post-installation.

Such moisture typically collects below the closure assembly, where it can cause rot and other undesirable damage to both the closure assembly and the structure below the closure assembly. In some situations attempts to prevent water penetration around closure assemblies may actually trap the water within the structure, exacerbating the problem.

Various drain holes systems for closure assemblies have been used to divert water from the structure, such as disclosed in U.S. Pat. Nos. 3,851,420 (Tibbetts); 4,691,487 (Kessler); and 5,890,331 (Hope).

Specialized flashing structures have been developed for installation in the gap between the rough opening and the closure assembly. Examples of such specialized flashing structures are shown in U.S. Pat. Nos. 4,555,882 (Moffitt et al.); 5,542,217 (Larivee); and 6,098,343 (Brown et al.). U.S. Pat. Nos. 5,822,933 (Burroughs et al.) and 5,921,038 (Burroughs et al.) disclose a water drainage system with an angled pan and a plurality of ribs that is located underneath a closure assembly.

These specialized flashing structures, however, do not effectively remove water from the interior of the structure. Additionally, the installation of moisture guards often requires changes in the way the closure assembly is installed into the rough opening and how the closure assembly is finished on the room side so as to accommodate the vertical height of the angled pan. Furthermore, the gap between the closure assembly and the rough opening must be sufficient to accommodate the raised end of the angled pan.

The Installation Instructions for New Construction Vinyl Window with Integral Nailing Fin published by Jeld-Wen, Inc. discloses installing a 6" tall section of screen to the exterior of the structure below the closure assembly. The screen extends about the width of the closure assembly and is located on top of flashing tape and building wrap. Another layer of flashing tape is applied to the top of the screen. The screen, however, forms one contiguous channel that is too large to permit effective drainage of water.

BRIEF SUMMARY OF THE INVENTION

The present invention is directed to methods of installing closure assemblies in a rough opening in a structure. The present methods reduce the time and cost of installing closure assemblies, while increasing the performance of the closure assembly.

In one embodiment, an insertion opening is formed in the water resistant barrier generally corresponding to a perimeter of the rough opening. A moisture barrier is located on a bottom inner surface of the rough opening. The moisture barrier extends generally vertically downward below the rough opening along an external surface of the moisture resistant barrier to form a vertical portion. A channel assembly is located generally below the rough opening so that at least one channel entrance is proximate the bottom inner surface of the rough opening and at least one discharge opening is directed toward a drainage area. The closure assembly is inserted into the rough opening and temporarily secured to the structure adjacent the rough opening. At least one adjustable shim is adjusted to accurately position the closure assembly in the rough opening. In some embodiments, constant pressure shims can be added to, or substituted for, the adjustable shim. A sealing member attached to the closure assembly is engaged with the water resistant barrier. A watershed arrangement is formed with the sealing member and water resistant barrier at the header of the closure assembly. A foam material is delivered into at least a portion of a space between perimeter edge surfaces of the closure assembly and inner surfaces of the rough opening to permanently secure the closure assembly within the rough opening.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
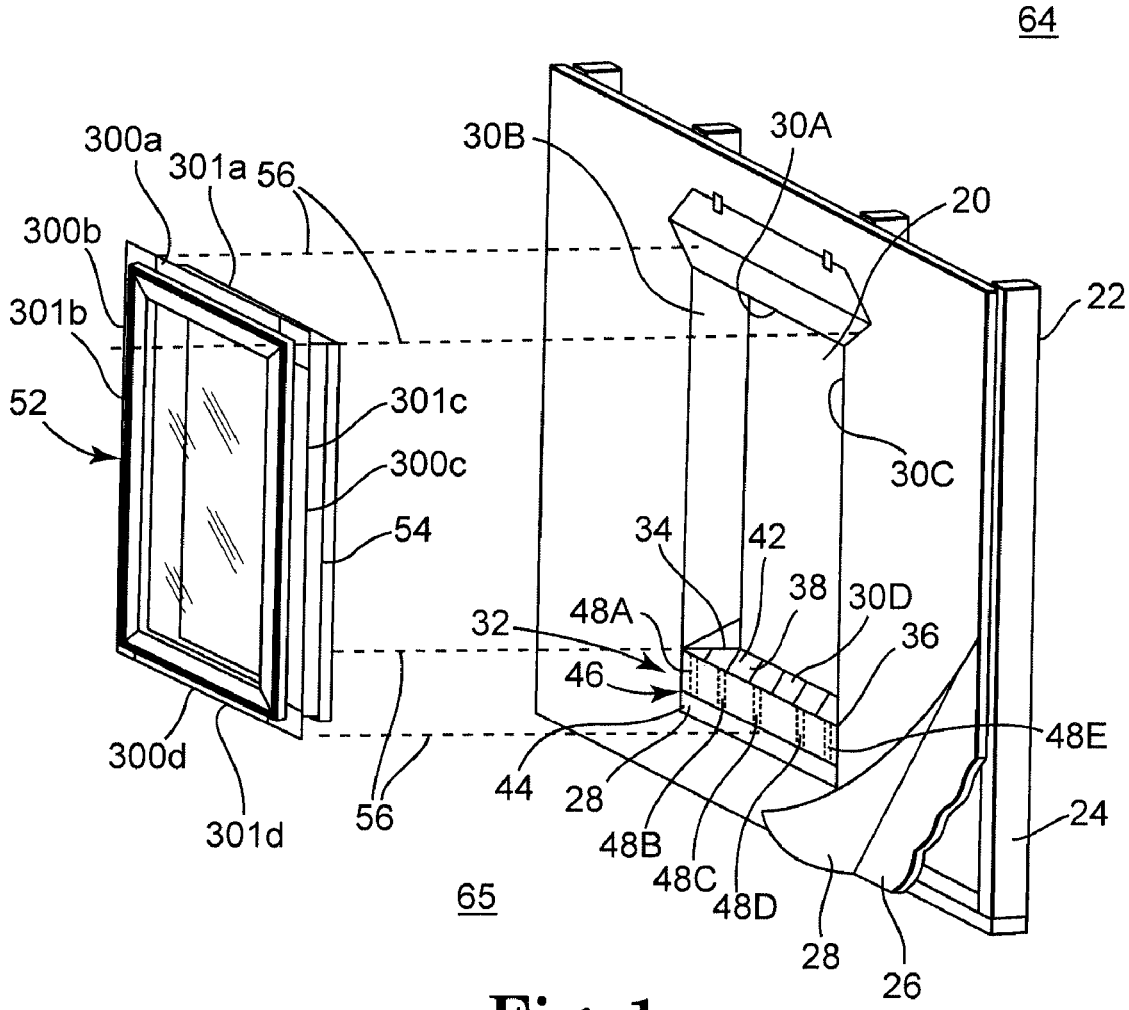
FIG. 1 is an exploded perspective view of a structure and a closure assembly with a drainage system in accordance with one embodiment of the present invention.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION OF THE INVENTION

The present invention is directed to a system for installing a closure assembly in a rough opening. As used herein, "closure" and "closure assembly" refer to double-hung, casement, awning and fixed windows, skylights, sliding and hinged doors, and the like. As used herein, "rough opening" refers to an opening in a wall or structure that has a perimeter sized and shaped to receive the closure assembly, and a plurality of inner surfaces. As used herein, "inner surfaces" refers to the sill, header and jamb surfaces forming the rough opening in the structure. The rough opening extends from an interior side of the structure to an exterior side. The exterior side of the structure is typically exposed to rain, wind, snow, ice and the like, while the interior side is typically protected from the elements.

FIG. 1 illustrates a structure 22 that includes framing members 24, a sheathing layer 26 and a water resistant barrier 28. In another embodiment, the structure 22 is formed of a composite panel and a water resistant barrier 28. A rough opening 20 extends through the structure 22 from an interior side 64 of the structure 22 to an exterior side 65 of the structure 22. The water resistant barrier 28 preferably wraps around at least a portion of inner surfaces 30A, 30B, 30C, 30D of a rough opening 20 in the structure 22. The water resistant barrier 28 preferably wraps onto inner surface 30D located at the bottom of the rough opening 20. A method of wrapping the water resistant barrier 28 is discussed in greater detail later on. In other embodiments, however, the water resistant barrier 28 is not wrapped onto the inner surfaces of the rough opening 20. A closure assembly 52 in accordance with one embodiment of the present invention is also shown.

In one embodiment, sealing members 300*a*-300*d* are attached substantially around a perimeter of the closure assembly 52 at a remote location. As used herein, "remote location" refers a location remote from the rough opening 20, such as a manufacturing facility. This permits the sealing members 300*a*-300*d* to be factory installed prior to the closure assembly 52 being shipped to the installation site. Distal edges 301*a*-301*d* of the sealing members 300*a*-300*d* are positioned toward an exterior side of the closure assembly 52 (corresponding to the exterior side 65 of the structure) for installation. In the illustrated embodiment, the sealing members 300*a-d* are foil-backed butyl flashing. However, the sealing members 300*a*-300*d* may have other configurations as are known in the art, some of which are discussed in further detail later on. In addition, sealing members 300*a*-300*d* may be replaced with a single continuous sealing member.

Figure 2:
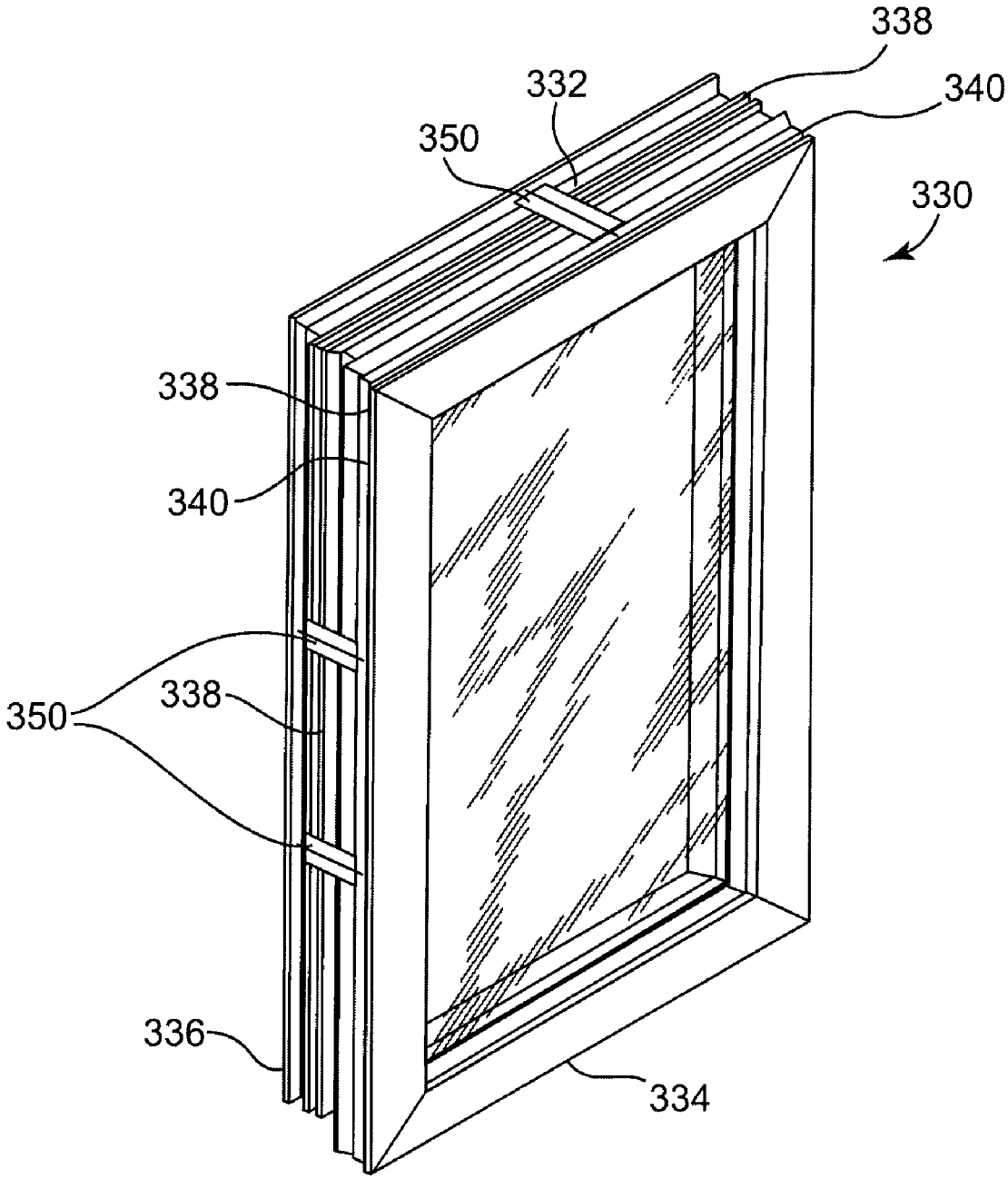
FIG. 2 is a perspective view of a closure assembly and an adjustable shim in accordance with the present invention.

FIG. 2 illustrates an exemplary closure assembly 330 for installation in the rough opening 20. Closure assembly 330 may be substituted for closure assembly 52 in the embodiment shown in FIG. 1. Closure assembly 330 includes a frame 332 with an exterior sealing plane 334 and an interior sealing plane 336. As used herein, "exterior sealing plane" refers to a plane extending across the generally outermost external surfaces of the closure assembly 330. As used herein, "interior sealing plane" refers to a plane extending across the generally outermost internal surfaces of the closure assembly 330.

Located generally between the exterior sealing plane 334 and the interior sealing plane 336 of the closure assembly 330 is a perimeter edge surface 338. The perimeter edge surface 338 includes one or more surfaces on the perimeter of the closure assembly 330 that extend between the exterior and interior sealing planes 334, 336. As used herein, "perimeter edge surface" refers to one or more surfaces located between interior and exterior sealing planes of the closure assembly 330.

In one embodiment, the perimeter edge surface 338 includes one or more longitudinal recesses 340. In one embodiment, one or more shims 350 are releasably attached or coupled to the longitudinal recess 340, preferably along each side of the closure assembly 330. The shims 350 may be attached to the closure assembly 330 at a remote location or at the installation site.

Figure 3:
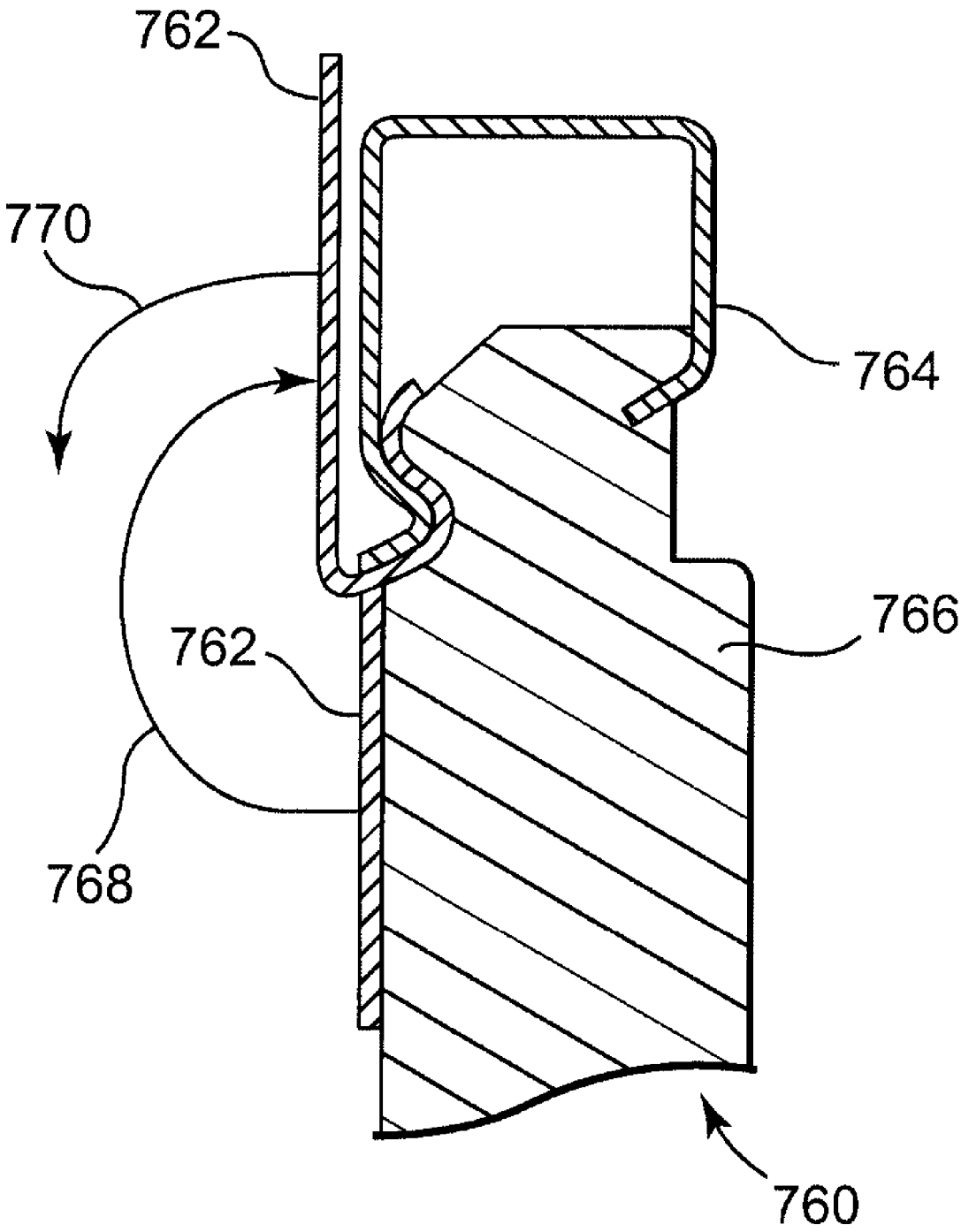
FIG. 3 is a sectional view taken along a horizontal axis of a closure assembly frame showing an alternate sealing member in accordance with the present invention.

FIG. 3 illustrates an alternate closure assembly 760 with a flexible sealing member 762 captured between a metal cladding 764 and the wood frame 766 of the closure 760. The metal cladding 764 may be aluminum, and the wood frame 766 may be a wood jamb. In the illustrated embodiment, the sealing member 762 is a flexible gasket that preferably extends around the entire perimeter of the closure assembly 760. The sealing member 762 can be constructed from a variety of flexible polymeric materials, such a for example rubber, metal foil, and composites thereof. In one embodiment, the sealing member 762 includes an adhesive layer covered by a release liner.

In one embodiment, the sealing member 762 is positioned against the wood jamb 766 during shipping. Prior to installation, a distal edge of the sealing member 762 is positioned towards the exterior side 65 of the closure assembly 760. In the illustrated embodiment, the sealing member 762 is folded forward along arc 768 until it is adjacent to the aluminum cladding 764. Once the closure assembly 760 is positioned in the rough opening 20, the sealing member 762 is folded along arc 770 and attached to the structure 22 adjacent the rough opening 20.

Figure 4:
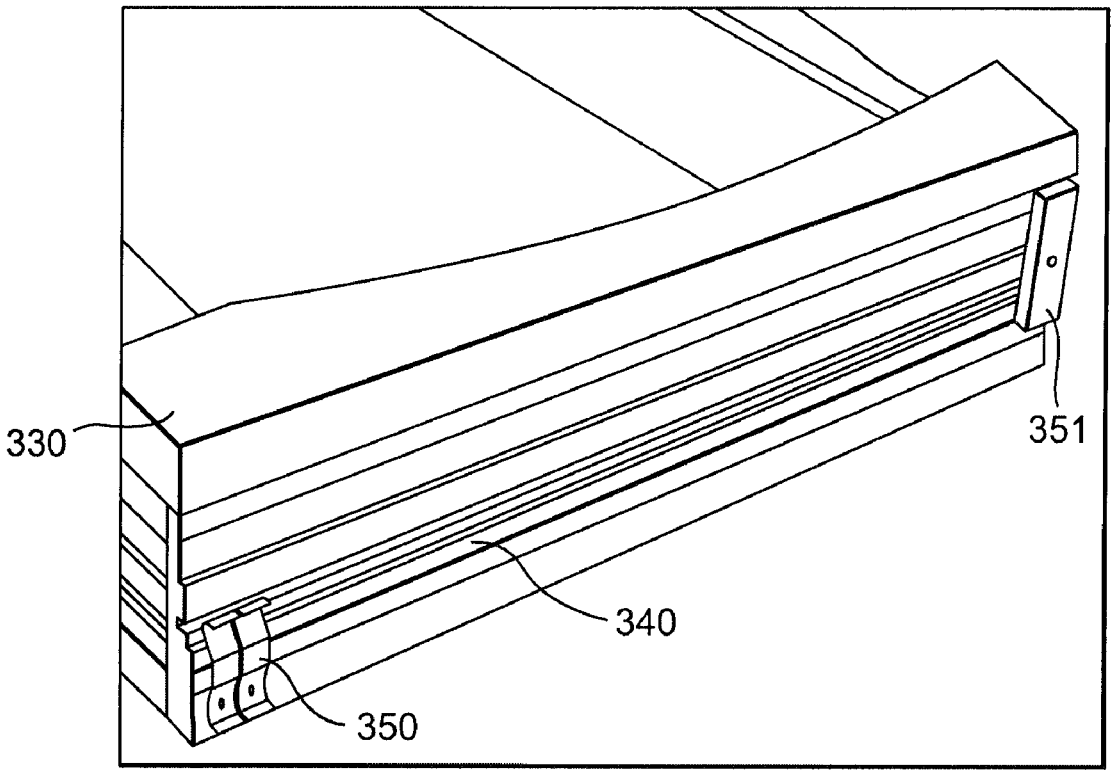
FIG. 4 is a schematic view of a portion of the closure assembly detailing a shim arrangement.

Referring now to the closure assembly 330 of FIG. 2, FIG. 4 shows a bottom view of the closure assembly 330. The closure assembly 330 may include one or more adjustable shims 350 for use in verifying that the closure assembly 330 is accurately positioned within the rough opening 20. In the preferred embodiment, the adjustable shims 350 are releasably attached to the closure assembly 330 at a location remote from the rough opening 20, such as a manufacturing facility. The closure assembly 330 is preferably packaged and shipped with the adjustable shims 350 pre-attached. Alternatively, some or all of the adjustable shims 350 can be snap-fit into the longitudinal recess 340 at the installation site. The adjustable shims 350 can preferably be attached and detached from the recess 340 without the use of tools. In one embodiment, the adjustable shims 350 are adapted to form a snap-fit relationship with the longitudinal recess 340. In another embodiment, one or more fixed or block shims 351 may be used in combination with the adjustable shim 350 to form a more complex shim arrangement.

Figure 5:
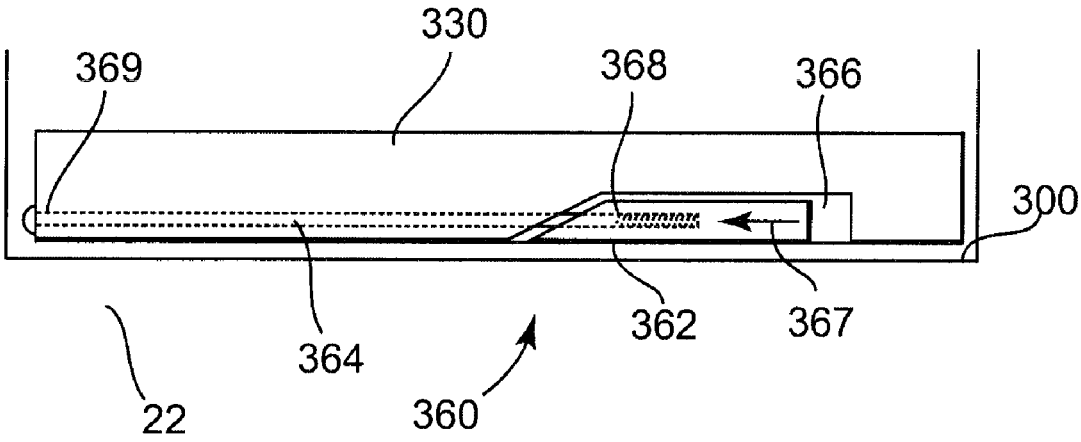
FIG. 5 is an end view of an adjustable shim for use with the closure assembly.

FIG. 5 illustrates one embodiment of an adjustable shim 360 that may be used to verify that the closure assembly 330 is accurately positioned within the rough opening 20. Shim 360 includes a wedge member 362 and a screw 364. The wedge member 360 is received in a wedge-shaped pocket 366 in the closure assembly frame. The screw 364 is rotatably coupled to the wedge member 362 at a traveling end 368 and has a driving end 369 that is accessible at a perimeter of the closure assembly 330. As the screw 364 is torqued at the driving end, the wedge member 362 travels along the driving end 369 of the screw 364 within the pocket 366 as indicated by arrow 367. As the wedge member 362 travels horizontally along the angled portion of the pocket 366, the closure assembly 330 moves in a vertical direction. The shim 360 may be adjusted to accurately position the closure assembly 330, for example by leveling the closure assembly 330 or by centering the closure assembly 330 within the rough opening 20.

Figure 6:
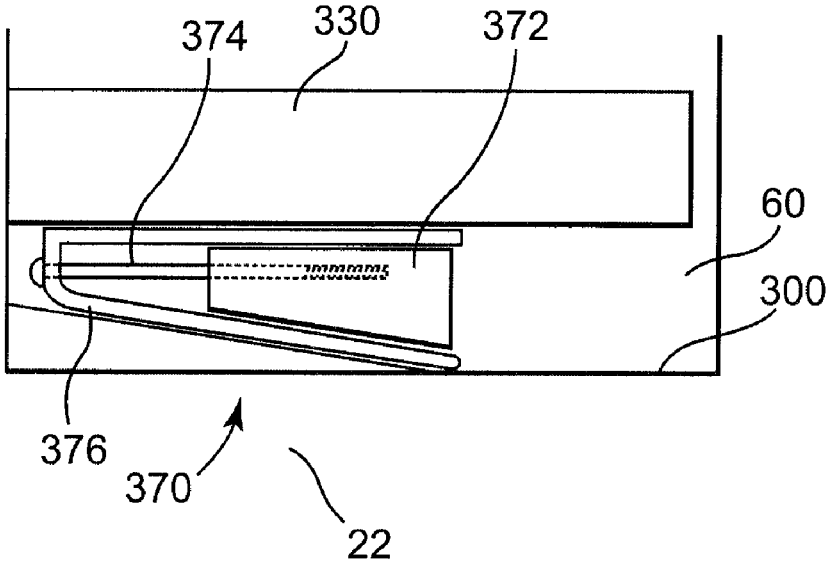
FIG. 6 is an end view of an adjustable shim for use with the closure assembly.

FIG. 6 illustrates another embodiment of an adjustable shim 370 that may be used to verify that the closure assembly 330 is accurately positioned within the rough opening 20. Adjustable shim 370 includes a wedge member 372 and a screw 374. Adjustable shim 370 is generally similar to adjustable shim 360 as described with respect to the embodiment shown in FIG. 5 and is operated in a similar manner. However, rather than being received in a pocket in the closure assembly frame, shim 370 is received in a wedge-shaped receiving member 376 located in a gap 60 between the closure assembly 330 and the sill surface 30D of the rough opening 20. This embodiment does not require that the closure assembly frame be modified to include the pocket 366 as shown in FIG. 5. Rather, the adjustable shim 370 is separate and may be added to any closure frame.

Figure 7:
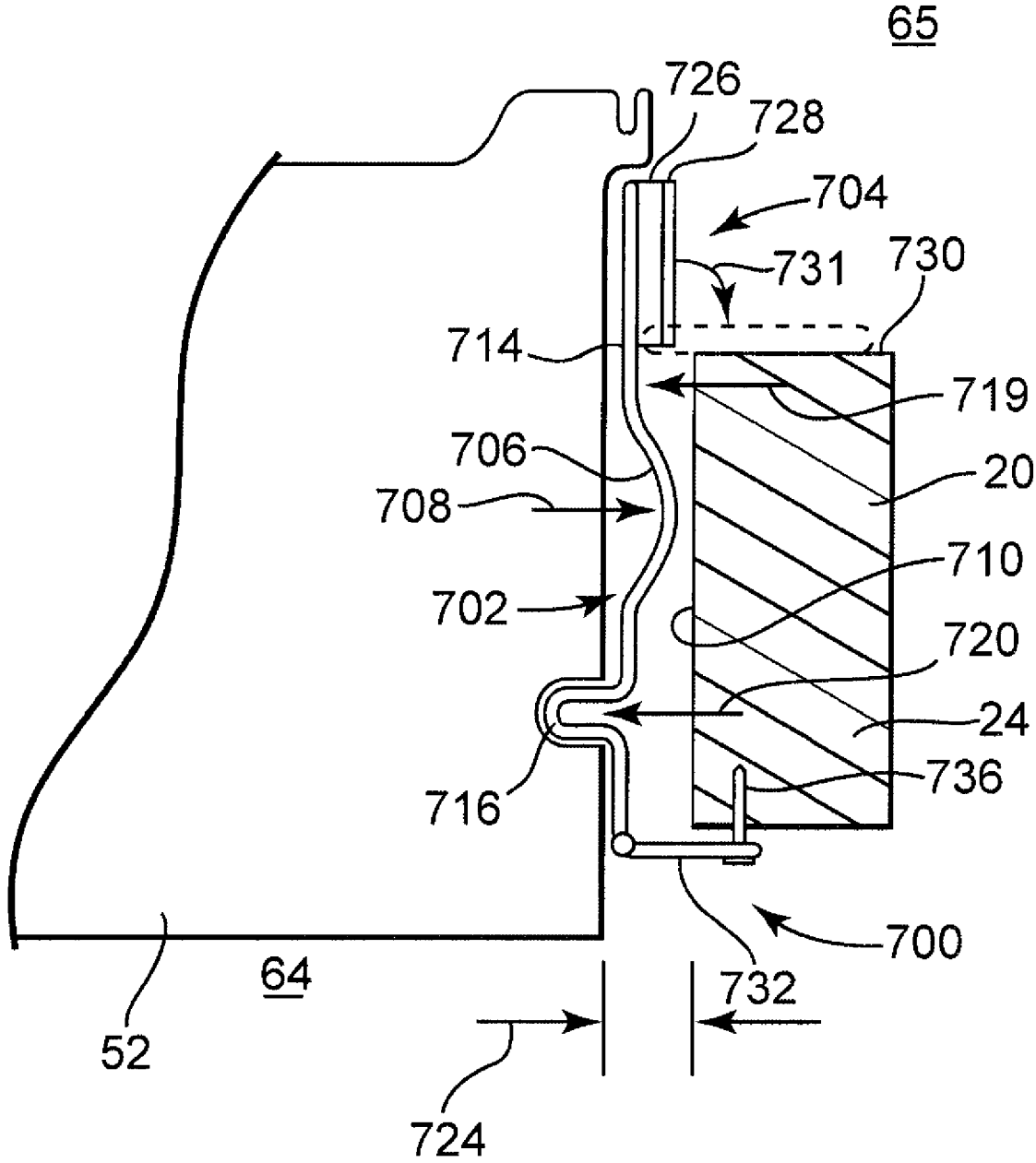
FIG. 7 is a sectional view taken along a horizontal axis of a constant pressure shim in accordance with the present invention.

FIG. 7 illustrates an alternate shim system 700 in accordance with the present invention. Alternate shim system 700 is described in reference to closure assembly 52, but may be used with any closure assembly described herein. In the illustrated embodiment, a constant pressure shim 702 is combined with sealing member 704. The shim system 700 is preferably contracted from a resilient material, such as for example metal or plastic, that is capable of substantially returning to an original shape or position after having been compressed. In the illustrated embodiment, the sealing member 704 is integrally formed from the same material used to construct the constant pressure shim 702. In an alternate embodiment, the constant pressure shim 702 and the sealing member 704 can be constructed from different materials.

The constant pressure shim 702 includes spring portion 706 that applies force 708 against an interior surface 710 of the frame member 24 defining the rough opening 20. Portions 716, 724 apply forces 719, 720 against the closure assembly 52. In the illustrated embodiment, portion 716 is attached to the closure assembly 52. Force 708 and the forces 719, 720 generated by the spring portion 706 are balanced to maintain a gap 724 between the closure assembly 52 and the interior surface 710. When multiple constant pressure shims 702 are positioned around the perimeter of the closure assembly 52, the forces 708, 719, 720 may be used to accurately position the closure assembly 52 in the rough opening 20.

In the illustrated embodiment, the sealing member 704 includes an adhesive layer 726 covered by a release liner 728. During installation of the closure assembly 52, the release liner 728 is removed and the sealing member 704 is folded as shown by arrow 731 so that the adhesive layer 726 bonds to a surface 730 on the exterior side 65 of the structure.

The alternate shim system 700 optionally includes a stop 732 that limits how far the closure assembly 52 is inserted in the rough opening 20. The stop 732 is preferably integrally formed from the same material as the constant pressure shim 702 and the sealing member 704. In the illustrated embodiment, the stop 732 is located near the interior side 64 of the closure 52. Consequently, the closure assembly 52 is preferably inserted from the interior side 64 of the rough opening 20. In one embodiment, the stop 732 is used to secure the closure assembly 52 in the rough opening 20, such as by securing the constant pressure shim 702 to the frame member 24 with fastener 736.

Figure 8:
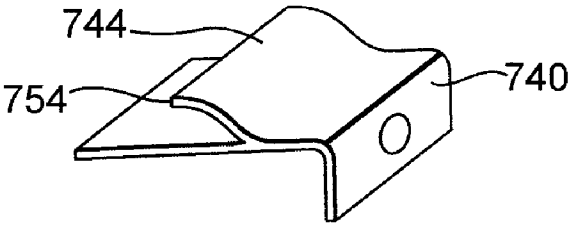
FIG. 8 is an alternate constant pressure shim in accordance with the present invention.
Figure 9:
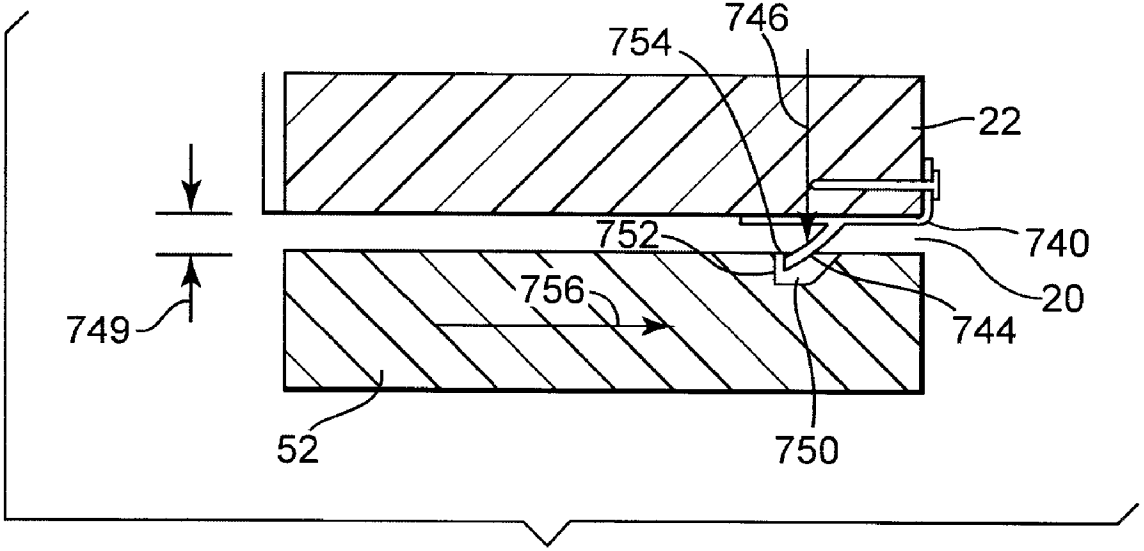
FIG. 9 is a sectional view of the constant pressure shim of FIG. 8 engaged with a closure assembly.

FIGS. 8 and 9 illustrate an alternate constant pressure shim 740 in accordance with the present invention. Again, constant pressure shim 740 is described in reference to closure assembly 52, but may be used with any closure assembly described herein. The constant pressure shim 740 is approximately L-shaped and has a spring portion 744. As illustrated in FIG.

9, the constant pressure shim 740 is optionally attached to the structure 22 adjacent the rough opening 20. Spring portion 744 applies force 746 on the closure assembly 52 to maintain gap 749.

The closure assembly 52 optionally includes a groove 750 having a surface 752 that engages with a distal end 754 of the spring portion 744. Once engaged, the distal end 754 prevents the closure assembly 52 from being displaced in direction 756. The spring portion 744 also serves to position the closure assembly 52 in the rough opening 20. In one embodiment, the constant pressure shim 740 is used only to position and secure the closure assembly 52 in the rough opening 20.

Various additional shims and shim systems suitable for use with the present invention are described in U.S. patent application Ser. No. 11/089,847, entitled Installation Method and System for a Closure Unit, which is hereby incorporated by reference.

Figure 10:
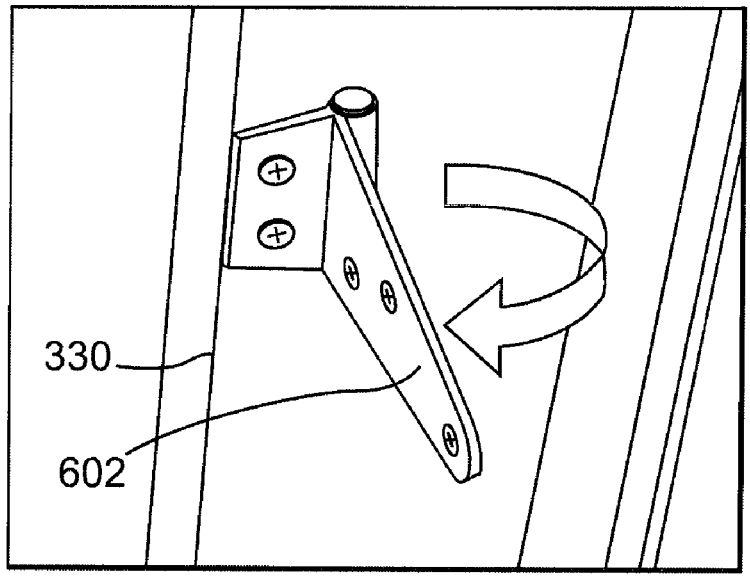
FIG. 10 is a schematic illustration of the closure frame detailing a securing member.
Figure 11:
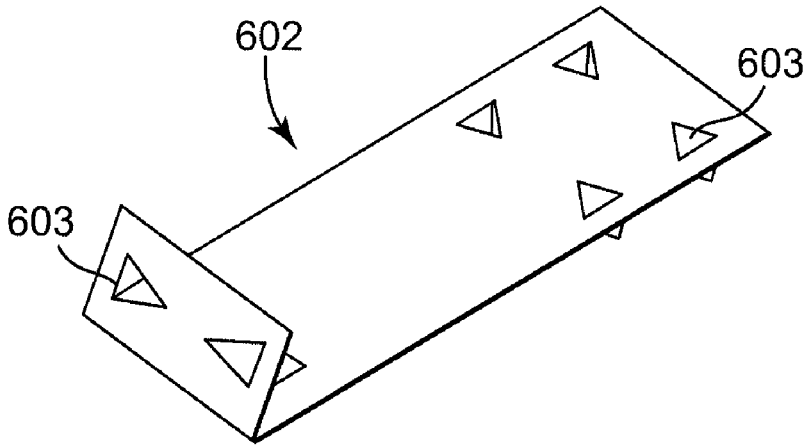
FIG. 11 is a schematic view of an alternate securing member for use with the closure assembly.

A closure assembly in accordance with the present invention, such as closure assembly 330 as previously described, optionally includes one or more securing members 602, shown in FIG. 10, carried on the closure assembly 330. The securing members 602 may have a variety of configurations. For example, the securing members 602 may be brackets and may include through holes for receives screws or nails, as illustrated in FIG. 10. In other embodiments, the securing members 602 may include pre-formed barbs 603 that can be tapped into the structure 22 surrounding the rough opening 20 (See FIG. 11). In still other embodiments, the securing members may include an adhesive to effect securing.

Securing members 602 are employed to provide convenient securing of the closure assembly 330 within the rough opening 20 during installation. The securing members 602 are preferably attached to the closure assembly 330 at location remote from the rough opening 20 prior to installation of the closure assembly 330, such as a manufacturing factory. This embodiment permits the securing members 602 to be factory installed prior to the closure assembly 330 being shipped to the installation site. In other embodiments, however, the securing member(s) 602 are attached to the closure assembly 330 at the installation site.

The securing members are mounted proximate an interior portion of the closure assembly 330. In one embodiment, the securing members 602 are mounted on the closure assembly 330 in a shipping position that is folded or retracted for ease of packaging and shipping. The securing members 602 are deployable from the shipping position to insertion and/or attachment positions at the installation site for use, as shown by arrow 604. In some embodiments, the shipping position and the insertion position are the same, or the insertion position and the attachment position are the same. In other embodiments, the securing member 602 does not change position. In one embodiment, in the insertion position, the securing member 602 extends from the perimeter of the closure assembly 330 in the interior plane of the closure assembly 330. In this position, the securing member 602 may function as a stop, preventing over insertion of the closure assembly 330 from the interior side 64 of the structure 22. In other embodiments, a separate accessory carried on the closure assembly 330 may function as a stop for installation from either the exterior side 65 or the interior side 64 of the structure 22.

Figure 12:
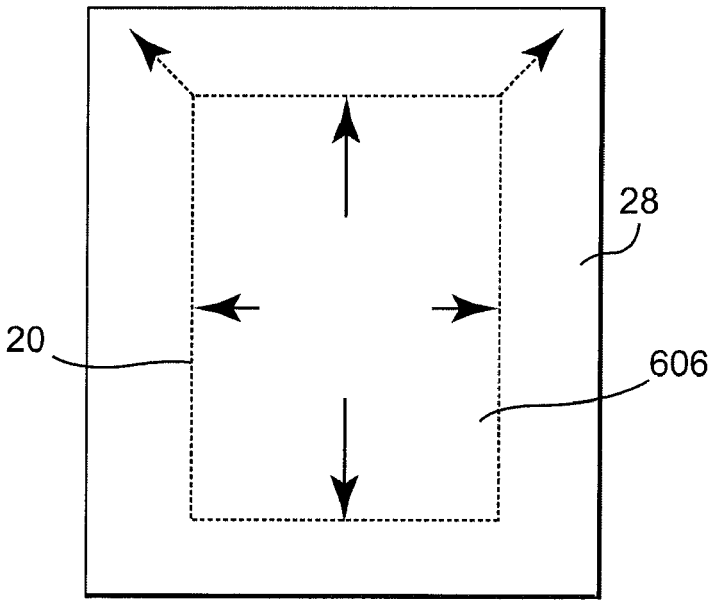
FIG. 12 is a schematic illustration of the cut lines for forming an insertion opening in the moisture barrier.
Figure 13:
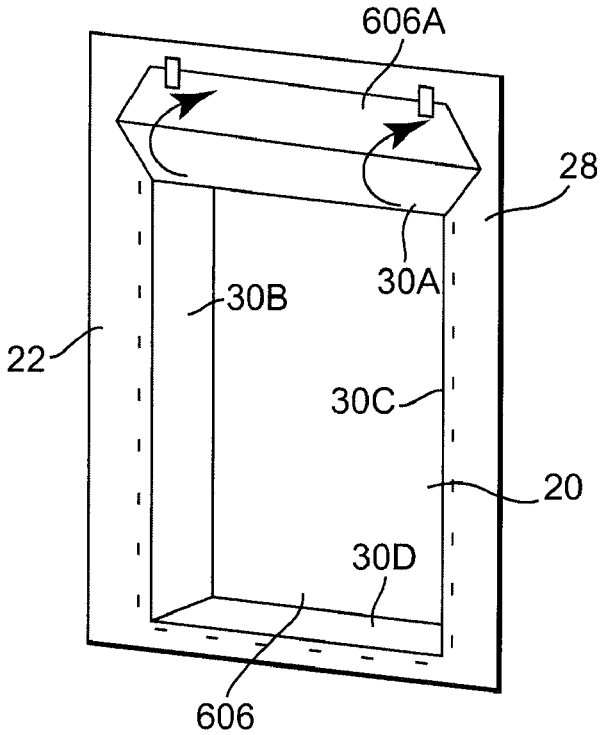
FIG. 13 is a schematic illustration of the arrangement of the moisture barrier flaps about the rough opening.

The closure assembly 52, or any other closure assembly described herein, is installed in the rough opening 20 as shown in FIGS. 12-21. First, an insertion opening 606 is cut into the water resistant barrier 28 generally corresponding to a perimeter of the rough opening 20, as shown in FIG. 12. A header flap 606A is cut in the water resistant barrier 28 and is folded away from the rough opening 20. The header flap 606A is temporarily fixed to the water resistant barrier 28 above the header surface 30A of the rough opening 20 as shown in FIG. 13.

Figure 14:
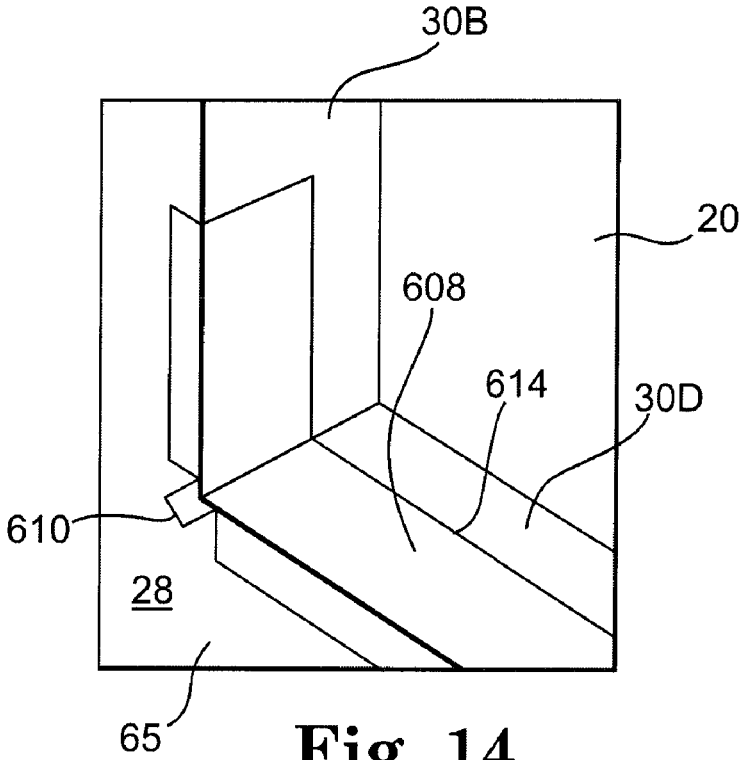
FIG. 14 is a schematic illustration of the configuration of the sealing member on the sill surface.
Figure 15:
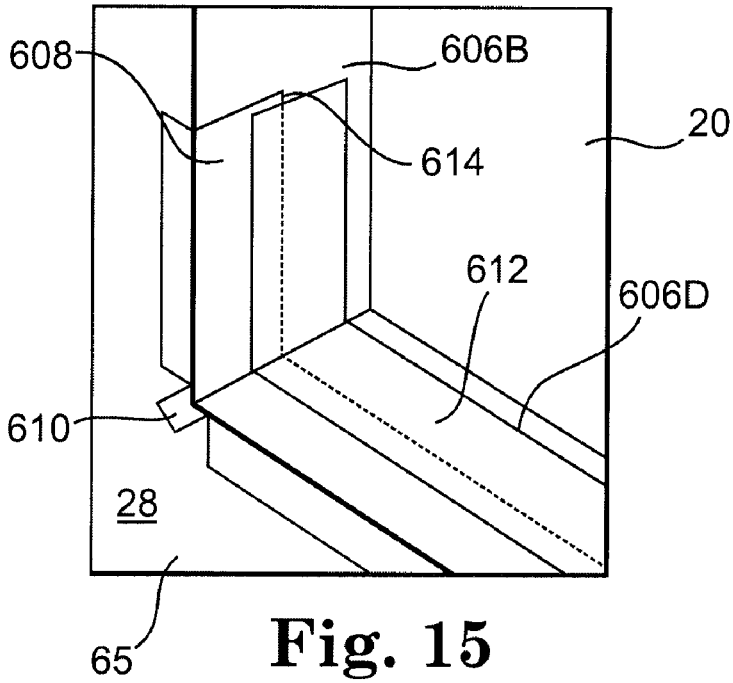
FIG. 15 is a schematic illustration of the configuration of the second sealing member on the sill surface.

Next, a flashing member 608 is applied over the jamb surface 30*d*. The flashing member 608 may be a foil backed flashing tape. Preferably, the flashing member 608 is longer than the length of the sill surface 30*d* so that the ends of the flashing member 608 extend up the jambs surfaces 30*b* and 30*c* (30*c* not visible) as well. The flashing member 608 is positioned partially forward of the plane of the rough opening 20 so that a portion of the flashing member 608 is located on the sill surface 30*d* and a portion of the flashing member 608 extends to the exterior side 65 of the structure 22. The exterior portion of the flashing member 608 is folded down and away from the rough opening 20 over the water resistant barrier 28. As shown in FIG. 14, tabs 610 may be cut into the flashing member 608 at the corners of the rough opening 20 so that the flashing member 608 is folded flat onto the water resistant barrier 28 below the rough opening 20. FIG. 15 illustrates a second flashing member 612 applied overlapping an interior edge 614 of the flashing member 608.

The preceding steps prepare the rough opening 20 to receive the closure assembly 52. The closure assembly 52 may include any combination of the features previously discussed, including adjustable shims, securing members, sealing members, etc.

In one embodiment of the present invention, as shown in FIG. 1, a drainage system 32 is installed in the rough opening 20 for draining collected moisture away from the closure assembly 52 to a drainage area. Various embodiments of the drainage system 32 and methods of installation are described in U.S. patent application Ser. No. 11/340,253, entitled High Performance Window and Door Installation, which is hereby incorporated herein by reference.

In one embodiment, the closure assembly 52 is installed into the rough opening 20 from the interior side 64 of the structure 22. Where the securing member 602 are pre-installed on the closure assembly 52, as previously discussed, the securing members 602 are folded from the shipping position to the installation position and the closure assembly 616 is placed in the rough opening 20, care being taken not to dislodge the drainage system (if installed). In other embodiments, however, the closure assembly 52 is installed into the rough opening 20 from the exterior side 65 of the structure 22. The closure assembly 52 may be inserted into the rough opening 20 until a stop structure, such as the securing member 602, engages the structure 22 (see FIG. 16).

The position of the securing member 602 in the installation position may be chosen such that the interior plane of the closure assembly 616 is flush or at a pre-selected position relative to the interior plane of the structure 22. In this manner, over insertion of the closure assembly 52 may be reduced. This may also function as a safety feature, aiding in preventing the closure assembly 52 from tipping through the rough opening 20. Furthermore, the stop may provide a quick and easy method of aligning the interior plane of the closure assembly 616 with the interior plane of the structure 22.

Figure 17:
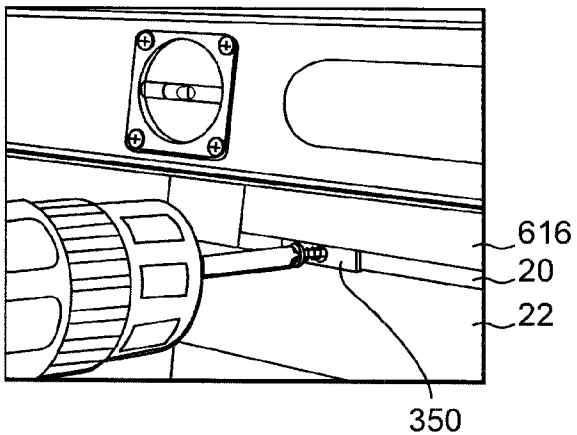
FIG. 17 is a schematic illustration detailing the step of accurately positioning the closure assembly within the rough opening.

Next, it is verified that the closure assembly 52 is accurately positioned within the rough opening 20. This step may entail making adjustments to the position of the closure assembly 52, as shown in FIG. 17, so that the closure assembly 52 is level or centered within the rough opening 20. In one embodiment, one or more shims 350 carried on the closure assembly 52 as 52. The height or displacement of the shim may be adjusted to level the closure assembly 52. In other embodiments, shims are inserted between closure frame and either or both of the sill surface 30D or jamb surface 30B, 30C (not shown). A combination of adjustable shims, block or wedge shims, or constant pressure shims may be used to accurately position the closure assembly 52. This step may further include adjusting the position of a shim relative to the closure assembly 52, by, for example, sliding the shim along the frame to a selected location for engaging the structure 22.

Figure 16:
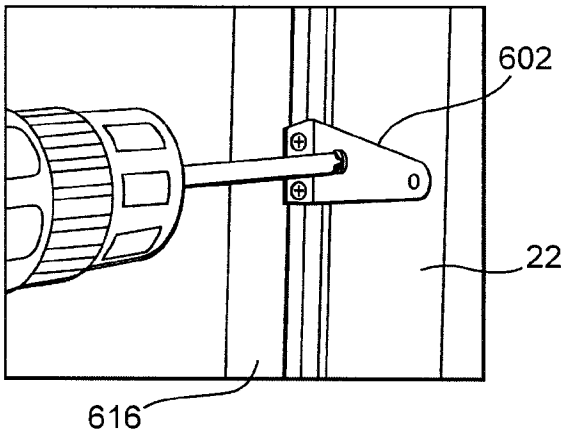
FIG. 16 is a schematic illustration detailing the step of attaching the securing members to the frame.

The closure assembly 52 is then secured in the rough opening 20. In one embodiment, the closure assembly 52 is secured in the rough opening 20 by engaging the securing member 602 with an interior portion of the rough opening 20. The securing member 602 may be deployed or opened from the insertion position to the attachment position for engaging the interior portion of the rough opening 20. The securing members 602 are attached to the structure 22 to hold the closure assembly 52 in place, as shown in FIG. 16. This step may entail screwing or nailing driving members through the securing members 602 and into the structure 22. Alternately, according to the configuration of the securing members 602, barbs 603, for example, can be tapped into the structure 22 to secure the closure assembly 52 (See FIG. 11).

Figure 19:
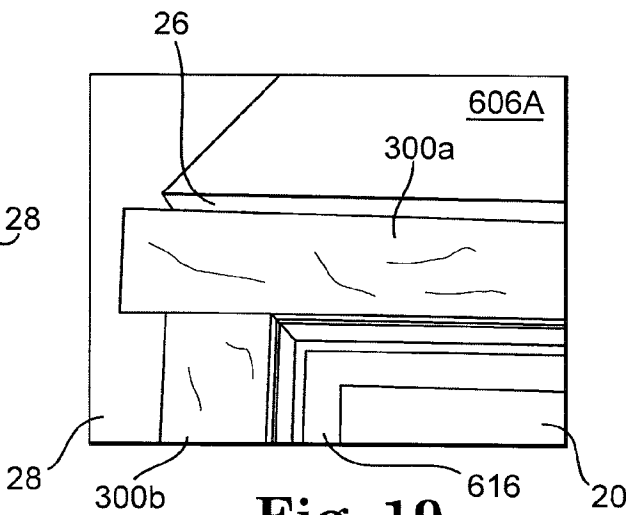
FIG. 19 is a schematic illustration detailing the formation of a watershed configuration with the sealing members over the header of the rough opening.
Figure 18:
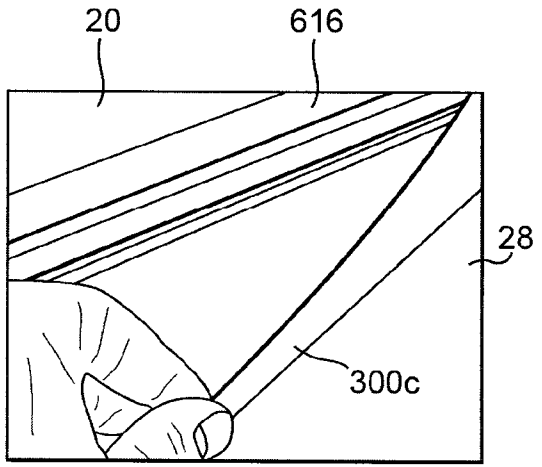
FIG. 18 is a schematic illustration detailing the step of attaching the sealing member carried on the closure assembly to the structure.

Referring now to FIG. 19, next, sealing members 300*b-d* attached to the closure assembly 52 are engaged with the structure 22 on the exterior side 65 proximate the rough opening 20 to form a seal around the exterior perimeter of the closure assembly 52, thus preventing the ingress of moisture into the structure 22 (see FIG. 1). In one embodiment, sealing members 300*b-d* carried on the exterior perimeter of the closure assembly 52 are adhered to the water resistant barrier 28 surrounding the rough opening 20, as shown in FIG. 18. This step may include removing a release liner on the sealing members 300*b-d* (see FIG. 18) to expose an adhesive surface on the sealing members 300*b-d* and adhering the adhesive surface of the sealing members 300*b-d* to the water resistant barrier 28 adjacent the rough opening 20.

Figure 20:
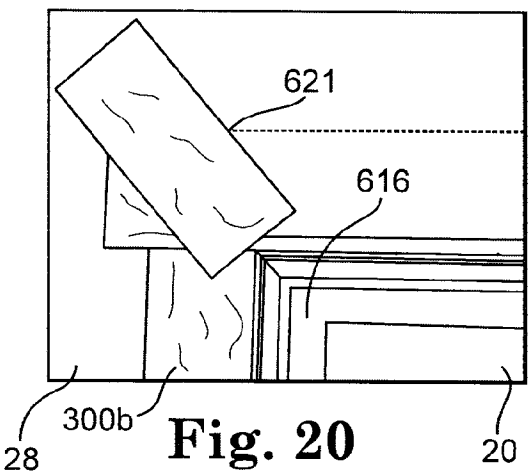
FIG. 20 is a schematic illustration detailing the step of sealing the ends of the header flap to the moisture barrier.

FIG. 19 shows that the header sealing member 300*a*, however, is adhered to the sheathing 26 at the top of the rough opening 20 because the header flap 606A is folded away from the rough opening 20. The header flap 606A is then folded down to overlap the header sealing member 300*a*. This provides a watershed arrangement whereby moisture is diverted to the exterior side of the closure assembly 52. As shown in FIG. 20, flashing or other flashing tape 621 is applied over the ends of the header flap 606*a* to seal the ends of the header flap 606*a* to the moisture barrier 28. In general, flashing tape 621 is applied in alignment with the angle of the ends of the header flap 606*a*. Thus, in one embodiment, as shown in FIG. 20, the flashing tape 621 is applied at a 450 angle to cover the ends of the header flap 606*a*. Optionally, flashing is applied over the long edge of the header flap 606A to seal the header flap 606*a* to the header sealing member 300*a* (not shown). Flashing tape 621 may be a foil backed butyl tape or other flashing, similar to the flashing applied to the water resistant barrier 28 at the sill member 30D.

Figure 21:
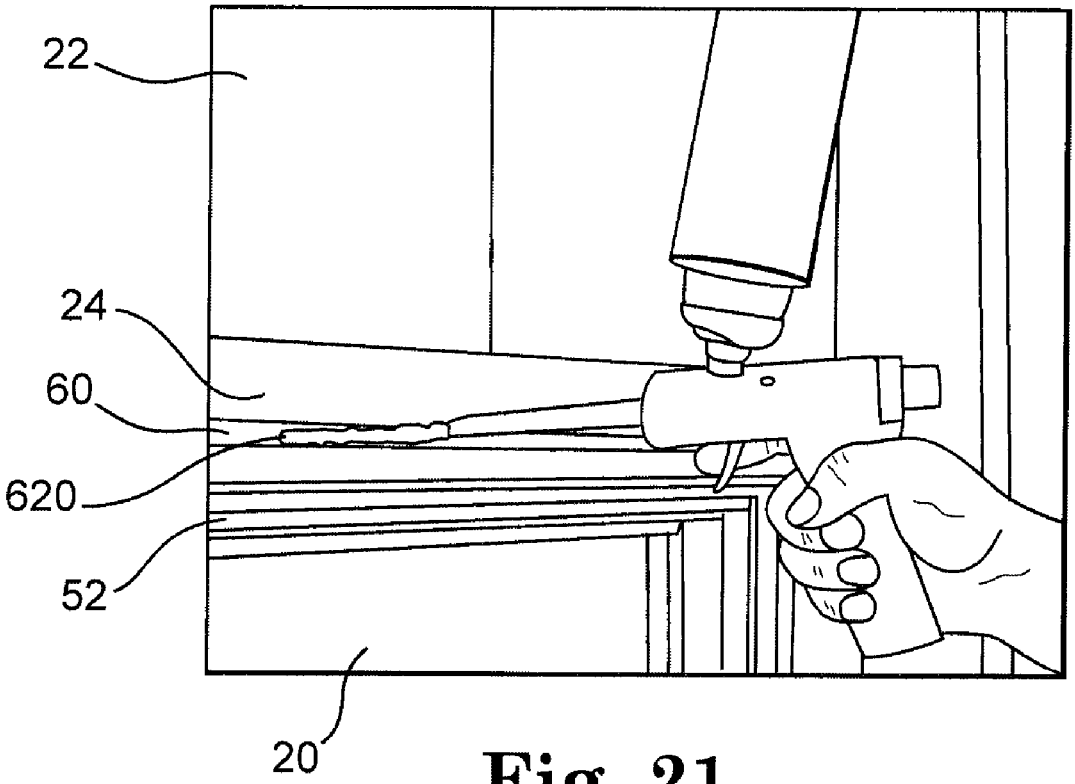
FIG. 21 is a schematic illustration detailing the step of delivering a foam material into a gap between the closure assembly and the frame.

Finally, the closure assembly 616 is secured within the rough opening 20. In one embodiment, a curable foam material 620 is delivered into the gap 60 between the boundaries of the rough opening 20 and the closure assembly 52 to provide the primary structural attachment of the closure assembly to the structure 22. The foam material 620 is delivered into the gap 60 with an injection gun as shown in FIG. 21. The foam is delivered into the gap 60 so as to form an attachment directly to the framing members surrounding the rough opening 20.

As used herein, "primary structural attachment" refers to a mechanism that provides at least 50% of an attachment force that resists separation of the closure assembly 616 from the framing members 24 or composite panel along a direction generally perpendicular to a major surface of the structure 22. That is, the shear characteristics of the foam material 620 are substantially greater than the anticipated force F. In the preferred embodiment, the cured foam material 620 preferably provides about 70%, and more preferably about 80%, and most preferably about 95%, of the attachment force.

In another embodiment, the substantially cured foam material 620 provides the sole structural attachment between the closure assembly 52 and the framing members 24 or composite panel. As used herein, "sole structural attachment" refers to a mechanism that provides 100% of an attachment force that resists separation of a closure assembly 616 from the structure 22 along a direction generally perpendicular to a major surface of the structure 22, excluding any attachment force provided by the securing members 602, fins (not shown) or the sealing arrangement.

In another embodiment, nails, screws or bolts are driven through a portion of the closure assembly 616 to secure the closure assembly 52 to the structure 22. When the closure assembly 52 is secured to the structure 22 thusly, a different method of preparing the rough opening 20 to receive the closure assembly 52 may be employed. Rather than cutting the water resistant barrier 28 to correspond to the rough opening 20, the flaps 606A-D of water resistant barrier 28 are formed at the header, sill and jamb members 30A-D. The sill and jamb flaps 606B-D are folded toward the inside of the rough opening 20 so that they cover the sill and jamb surfaces 30B-30D of the rough opening 20. The sill and jamb flaps 606B-D are affixed to the structure 22, for example by stapling or adhering. In one embodiment, the ends of the flaps 606A-D are cut at approximately a 45° angle. This configuration permits the flaps 606A-D to be folded inwardly without wrinkling the material of the moisture barrier 28. Flashing members 608 may be applied to the sill surface 30D over the sill flap 606D as previously described, and the watershed arrangement with the header flap 606A may be formed as previously described. The closure assembly 52 is then inserted into the rough opening 20 as previously described. This method may be employed when the closure assembly 616 is secured to the rough opening 20 by conventional means, for example, by nailing or bolting the closure assembly 52 to frame members 24 surrounding the rough opening 20, rather than with the curable foam 620.

Figure 22:
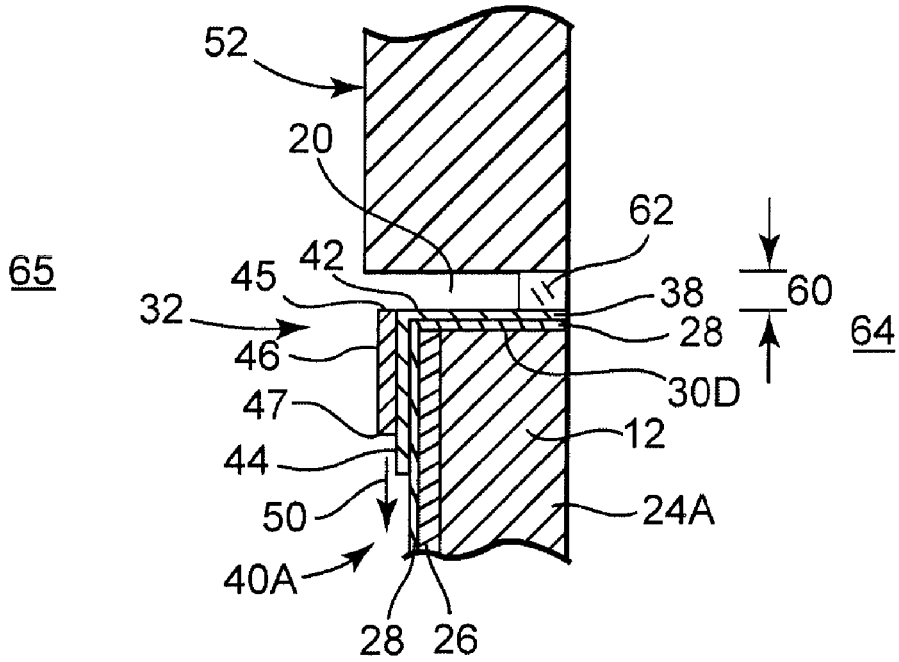
FIG. 22 is a cross sectional view of the drainage system of FIG. 1 with the closure assembly installed.

As best illustrated in FIG. 22, the rough opening 20 is larger than the closure assembly 52, creating gap 60 in which water may collect. As discussed previously, a drainage system 32 may be installed in the rough opening 20 in addition to the closure assembly 52. As indicated by the dashed lines 56, the closure assembly 52 is inserted into the rough opening 20 above the drainage system 32.

Figure 23:
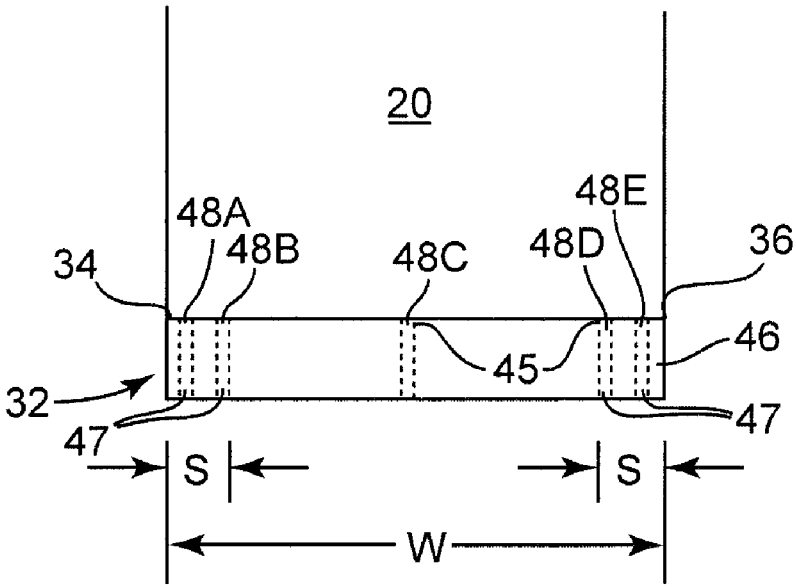
FIG. 23 is a front view of the drainage system of FIG. 1.

Referring generally to FIGS. 1 and 22-23, in one embodiment, the drainage system 32 includes a channel assembly 46 and a moisture barrier 38 positioned on the sill plate 24A. The channel assembly 46 is located on the generally vertical surface 44 of the moisture barrier 38 generally in front of the sill plate 24A. As will be discussed in detail below, the channel assembly 46 includes one or more channels 48A-48E (referred to collectively as "48") that are configured to siphon water on the collection surface 42 from the channel entrance 45 in direction 50 and out a discharge opening 47 to a drainage area 40A. As used herein, "siphon" refers to conduit that uses the weight of a liquid to pull the liquid from the higher level to a lower level.

The channels 48 can be located anywhere along the width W of the rough opening 20. Most water penetration, however, occurs between a closure assembly 52 and the vertical inner surfaces 30B, 30C of the rough opening 20. Water tends to concentrate on the collection surface 42 near the bottom corners 34, 36 of the rough opening 20. As used herein, the term "bottom corner" also refers to the intersection of a sill plate and a mullion separating adjacent closure assemblies, or the intersection of a sill plate and two vertical surfaces of adjacent closure assemblies. In the preferred embodiment, the channels 48 are concentrated near the bottom corners 34, 36. In one embodiment the channels 48A, 48B, 48C, 48D and 48E are located within a distance S from the bottom corners 34, 36. The distance S is preferably less than 4 inches, and more preferably less than 2 inches, and most preferably less than 1 inch.

Interior seal 62 is optionally located near an interior side 64 of the sill plate 24A to prevent water that collects in the gap 60 from migrating toward the interior 64 of the structure 22. In embodiments where the collection surface 42 is generally horizontal, the interior seal 62 is preferably included. Because the gap 60 is open to an exterior side 65 of the closure assembly 52 at least where any leaks are occurring, and likely through the channels 48 as well, the air pressure within the gap 60 will tend to be the same as the air pressure at the exterior side 65 of the closure assembly 52. The seal 62 isolates the gap 60 from air pressure on the interior side 64. This feature helps to ensure that the air pressure within the gap 60 is never lower than the air pressure on the exterior side 65, which could cause moisture to flow up the channels 48A-48E and into the gap 60.

The drainage system 32 removes moisture from the gap 60 in the following manner. As moisture leaks into the rough opening 20 from any location around the closure assembly 52, the moisture flows downwardly into the gap 60 under the force of gravity and collects on the collection surface 42. The collection surface 42 is water impermeable, so the sill plate 24A is protected from water damage.

Eventually, due to random accumulation and flow of moisture across the collection surface 42, or because the collection surface 42 is completely covered, moisture accumulates over the channel entrances 45. Surface tension in the water molecules will for a time prevent the moisture from flowing down the channels 48A-48E. However, as moisture continues to accumulate, the weight of the water causes the water immediately adjacent the channel entrances 45 to flow down the channels 48 and out the discharge openings 47 into the drainage area 40A. As water flows down the channels 48, a vacuum is created above the draining water, which draws more water down from the channel entrances 45, and so on. The negative or vacuum pressure of the descending water is strong enough to cause water on the collection surface 42 to be pulled towards the channel entrances 45. In this manner, moisture collecting on the collection surface 42 is removed to the drainage area 40A.

Because the channels 48 generate sufficient vacuum pressure to pull moisture from across the collection surface 42 towards the channel entrance 45, it is unnecessary for the collection surface 42 to be tilted or angled toward the channel assembly 46. Thus, a drainage system 32 in accordance with the present invention does not require substantial modifications to the closure assembly 52 installation procedures, nor to the closure assembly 52 or rough opening 20, as previously described.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What is claimed is:

1. A method of installing a closure assembly in a rough opening of a structure, the method comprising:

attaching a sealing member substantially around a perimeter of a closure assembly at a remote location;

positioning a distal edge of the sealing member toward an exterior portion of the closure assembly;

positioning a securing member proximate an interior portion of the closure assembly;

inserting the closure assembly into the rough opening from an interior side of the structure;

verifying that the closure assembly is accurately positioned in the rough opening;

securing the closure assembly in the rough opening;

engaging the sealing member attached to the closure assembly with an exterior surface of the structure proximate the rough opening; and delivering a foam material into at least a portion of a space between perimeter edge surfaces of the closure assembly and inner surfaces of the rough opening.

2. The method of claim 1 wherein attaching the sealing member substantially around the perimeter of the closure assembly comprises capturing the sealing member between a metal cladding on the exterior portion of the closure assembly and a wood frame of the closure assembly.

3. The method of claim 2 wherein positioning the distal edge of the sealing member toward the exterior portion of the closure assembly further comprises folding the sealing member along an arc until it is adjacent the metal cladding.

4. The method of claim 1 comprising attaching at least one sealing member comprising a continuous segment of water impermeable material around an entire perimeter of the closure assembly, the sealing member comprising a substantially unbroken water impermeable seal with the closure assembly.

5. The method of claim 1 comprising attaching the securing member to the closure assembly at a location proximate the interior portion of the closure assembly.

6. The method of claim 1 comprising attaching the securing member to the closure assembly in a shipping position at a remote location.

7. The method of claim 6 comprising folding the securing member from the shipping position to an insertion position at an installation site.

8. The method of claim 1 comprising folding the securing member to an attachment position after the closure assembly is located in the rough opening.

9. The method of claim 1 wherein the securing member comprises a stop that engages a perimeter of the rough opening.

10. The method of claim 1 comprising adjusting a shim attached to the closure assembly to level the window.

11. The method of claim 1 wherein securing the closure assembly in the rough opening further comprises attaching the securing member to the structure.

12. The method of claim 1 wherein engaging the sealing member with the exterior surface of the structure comprises folding the distal edge of the sealing member away from the exterior portion of the closure assembly.

13. The method of claim 1 wherein engaging the sealing member with the exterior surface of the structure comprises adhering at least a portion of the sealing member to a water resistant barrier on the exterior surface of the structure adjacent the rough opening.

14. The method of claim 1 wherein engaging the sealing member with the exterior surface of the structure further comprises forming a watershed arrangement with a portion of a water resistant barrier above the rough opening.

15. The method of claim 1 wherein the foam material provides the primary structural attachment of the closure assembly to the structure.

16. The method of claim 1 wherein the foam material provides the sole structural attachment of the closure assembly to the structure.

17. The method of claim 1 wherein the rough opening is covered by a water resistant barrier, the method further comprising forming an insertion opening in the water resistant barrier generally corresponding to a perimeter of the rough opening.

18. The method of claim 17 wherein forming the insertion opening comprises:

cutting a header flap in the water resistant barrier that extends downward into the rough opening; and temporarily securing the header flap above the rough opening.

19. The method of claim 18 comprising positioning a header flap in the water resistant barrier along an external surface of the sealing member to form a watershed arrangement.

20. The method of claim 18 further comprising sealing a header flap to an external surface of the sealing member.

21. The method of claim 1 further comprising installing a drainage system in the rough opening below the closure assembly.

22. The method of claim 1 further comprising attaching finish trim to the interior portion of the closure assembly before inserting the closure assembly in the rough opening.

23. The method of claim 22 wherein the finish trim is attached to the closure assembly at a remote location.

24. A method of installing a closure assembly in a rough opening of a structure, the method comprising:

locating a moisture barrier on a bottom inner surface of the rough opening by covering an exterior of the structure with the moisture barrier, forming flaps in the moisture barrier at a sill location and folding the sill flap toward the inside of the rough opening so that the sill flap covers a sill surface of the rough opening and the moisture barrier extends generally vertically downward below the rough opening along an external surface of the structure to form a vertical portion;

locating a channel assembly generally below the rough opening so that at least one channel entrance is proximate the bottom inner surface of the rough opening and at least one discharge opening is directed toward a drainage area;

attaching a sealing member substantially around a perimeter of a closure assembly at a remote location;

positioning a distal edge of the sealing member toward an exterior portion of the closure assembly;

inserting the closure assembly into the rough opening from an interior side of the structure;

securing the closure assembly in the rough opening;

engaging the sealing member attached to the closure assembly with an exterior surface of the structure proximate the rough opening; and delivering a foam material into at least a portion of a space between perimeter edge surfaces of the closure assembly and inner surfaces of the rough opening.

25. A method of installing a closure assembly in a rough opening of a structure, the method comprising:

attaching a sealing member substantially around a perimeter of a closure assembly at a remote location, the sealing member forming a flexible rubber gasket carrying an adhesive;

positioning a distal edge of the sealing member toward an exterior portion of the closure assembly;

attaching at least one adjustable shim to perimeter edge surfaces of the closure assembly;

inserting the closure assembly into the rough opening from an interior side of the structure;

adjusting the at least one adjustable shim to accurately position the closure assembly in the rough opening;

securing the closure assembly in the rough opening;

engaging the sealing member attached to the closure assembly with an exterior surface of the structure proximate the rough opening and adhering the rubber gasket to the structure; and delivering a foam material into at least a portion of a space between perimeter edge surfaces of the closure assembly and inner surfaces of the rough opening.

* * * * *